US009340947B2

(12) United States Patent
Henderson

(10) Patent No.: US 9,340,947 B2
(45) Date of Patent: May 17, 2016

(54) PERIMETER PILE ANCHOR FOUNDATION

(71) Applicant: Allan P. Henderson, Bakersfield, CA (US)

(72) Inventor: Allan P. Henderson, Bakersfield, CA (US)

( * ) Notice: Subject to any disclaimer, the term of this patent is extended or adjusted under 35 U.S.C. 154(b) by 424 days.

(21) Appl. No.: 13/788,458

(22) Filed: Mar. 7, 2013

(65) Prior Publication Data

US 2014/0255106 A1 Sep. 11, 2014

(51) Int. Cl.
*E02D 27/12* (2006.01)

(52) U.S. Cl.
CPC ..... *E02D 27/12* (2013.01)

(58) Field of Classification Search
CPC ..... E02D 27/12; E02D 27/14; E02D 27/16
USPC ..... 405/229, 231–233, 266, 267
See application file for complete search history.

(56) References Cited

U.S. PATENT DOCUMENTS

| | | | | |
|---|---|---|---|---|
| 3,429,126 | A * | 2/1969 | Wey Gino | 405/267 |
| 3,969,902 | A * | 7/1976 | Ichise et al. | 405/267 |
| 5,586,417 | A | 12/1996 | Henderson et al. | |
| 5,826,387 | A | 10/1998 | Henderson et al. | |
| 7,533,505 | B2 | 5/2009 | Henderson | |
| 7,618,217 | B2 | 11/2009 | Henderson | |
| 7,707,797 | B2 | 5/2010 | Henderson | |

* cited by examiner

*Primary Examiner* — Sunil Singh
(74) *Attorney, Agent, or Firm* — Jacobson Holman, PLLC.

(57) ABSTRACT

A perimeter pile anchor foundation is built by forming a plurality of individual perimeter pile anchors in a large generally circular pattern to form a perimeter wall. The individual pile anchors are contiguous, each pile overlapping the adjacent piles on either side. The overlapping pile anchors form an arch such that compression and friction between the pile anchors resist soil caving and sloughing pressure when soil inside the perimeter wall is excavated, enabling the perimeter pile foundation to be effectively constructed in weak saturated soils and/or cohesionless sands that will not allow conventional concrete foundation excavations. A concrete foundation ring is formed inside the pile perimeter wall to support a tall and/or heavy tower or other structure subject to high upset forces.

27 Claims, 9 Drawing Sheets

PERIMETER PILE ANCHOR FOUNDATION

BACKGROUND OF THE INVENTION

1. Field of the Invention

The present invention is related to the field of pile anchor foundations for supporting tall, heavy and/or large towers or the like which can be subject to high upset forces. More particularly, the present invention is directed to a perimeter pile anchor foundation including a plurality of pile anchors drilled in a circular or generally circular pattern so that adjacent piles overlap and form an arch with compression between the piles to resist soil caving in weak soils.

2. Description of the Related Art

In known pile anchor foundations, the piles extend downwardly from a foundation cap into the underlying soil and are spaced from one another. Such foundations are limited by soil conditions, as weak or wet soils will cave or sluff when, during construction, the ground under the center of the cap is excavated vertically.

Various forms of concrete foundations utilizing operational features of the instant invention have heretofore been disclosed in my earlier U.S. Pat. Nos. 5,586,417, 7,707,797 and 7,618,217 ("the '217 patent"), the disclosures of which are expressly incorporated herein in this application by reference as if fully set forth in their entirety. However, a need exists for a large deep concrete foundation capable of being constructed in cohesionless sands and weak soils with shallow ground water.

SUMMARY OF THE INVENTION

In view of the foregoing, the present invention is directed to a perimeter pile anchor foundation for supporting tower or other structures which may be subject to high upset forces. The foundation is built by drilling a plurality of individual perimeter pile anchors, or "piles", in a large circular or generally circular pattern. The individual piles are contiguous, each pile overlapping the adjacent piles on either side.

To construct the overlapping piles, the piles are divided into odd and even piles which alternate with one another around the perimeter of the foundation. Either the odd or the even piles may be constructed first. For purposes of this description, the odd piles are selected for forming first. The odd piles are formed by drilling a vertical hole for each pile, filling the hole with concrete, and inserting a centralized bolt vertically in the concrete (the order of the last two steps could be reversed). (The centralized bolts may later be post-tensioned, although post-tensioning is not necessary for the pile anchor bolts.) The concrete in the odd piles is then allowed to preset to a limited degree.

The even piles are arranged in between the odd piles. Therefore, after the concrete of the odd piles has preset, adjacent vertical holes are then drilled. Since the holes overlap to some extent, the concrete of the odd piles is shaved as the auger forms the hole for the even piles. The holes for the even piles are then filled with concrete and provided with vertically oriented centralized bolts in the same manner as with the odd piles.

In one preferred embodiment, the even and odd piles are offset from one another so that the diameter of the circle formed by the even piles is different from the diameter of the circle formed by the odd piles. This offset is typically in the range of one quarter to one half of the pile diameter. As a result, the total perimeter formed by the odd and even piles together is not a perfect circle.

Once the perimeter piles have been formed with the concrete fully set, an annular steel plate formed as a ring having holes therein is then placed on top of the perimeter piles. The centralized pile bolts extend through the holes and are secured with nuts to retain bolt tension. Alternatively, the ring may be formed by a plurality of individual steel plates, one for each pile. Individual steel plates provide for greater flexibility with respect to the adjoining relationship of the piles and the centralized pile bolts.

The perimeter piles form a perimeter wall to stabilize and retain the soil outside the wall. The soil inside the perimeter wall can then be safely excavated to form the large deep concrete foundation with the perimeter wall, without the soil caving or sloughing into the excavation.

An annular steel plate formed as a ring having holes therein is then placed on top of the perimeter piles. The centralized pile bolts extend through the holes and are secured with nuts to retain bolt tension. Alternatively, the ring may be formed by a plurality of individual steel plates, one for each pile. Individual steel plates provide for greater flexibility with respect to the adjoining relationship of the piles and the centralized pile bolts.

According to a first embodiment, a first corrugated metal pipe (CMP), also referred to herein as the outer CMP, is placed vertically in the excavation inside the perimeter wall formed by the contiguous piles leaving an outer annular space between the inside of the perimeter wall and the outside of the outer CMP. A foundation bolt cage, including a plurality of vertically oriented sleeved tower anchor bolts and a horizontally oriented embedment ring, is installed vertically inside the first CMP with the embedment ring at the bottom. According to a first configuration of the first embodiment, the tower anchor bolts are arranged in two concentric circles. In a second configuration of the first embodiment, the bolts are arranged in a single bolt circle. The tower anchor bolts, whether arranged in a single circle or in two concentric circles, are nutted above and below the embedment ring to secure the embedment ring in place near the bottom of the tower anchor bolts and concrete foundation to be formed. A second CMP, also referred to herein as the inner CMP, and smaller in diameter than the first CMP, is installed vertically inside the tower anchor bolts and the embedment ring. This creates an inner annular space between the outer and inner CMPs through which the tower anchor bolts extend vertically.

A concrete plug is then poured in the bottom of the inner CMP, after which the area inside the inner CMP atop the plug is backfilled with soil to approximately five feet below the surrounding ground surface. Electrical, communication, and grounding conduits are installed through the first and second CMPs, the tower anchor bolts, and the perimeter piles, and then backfilling of the inner CMP is completed to within a minimum of about six inches from the top of the inner CMP for the concrete floor 61. The inner annular space between the outer and inner CMPs through which the tower anchor bolts extend vertically is filled to within about three to four inches from the top of the CMPs to create a grout trough. The outer annular space between the inside of the perimeter wall and the outer CMP, and the floor 61 inside the inner CMP, are then filled with concrete. Once the concrete cures, shims are stacked as necessary to support level the tower base section for grouting, the three to four inch grout trough filled with grout, and the tower base section flange set over the tower anchor bolts on top of the shims and nutted at the top against the upper surface of the tower base flange so that the tower anchor bolts can be post-tensioned when connecting and securing the tower to the foundation. The embedment ring is locked into place near the bottom of the foundation by the nutted tower anchor bolts.

According to a second embodiment, after the perimeter piles are formed, only a single CMP, such as the inner CMP is vertically placed in the excavation inside the pile perimeter and spaced therefrom to create an annular ring between the CMP and the piles. A direct embedded section is suspended in position between the piles and the inner CMP. The direct embedded section includes a reinforcing steel cage formed by a loop of rebar having a generally U-shaped cross-section. The loop includes a piece of rebar bent to have a generally vertical inner leg and a generally vertical outer leg joined at the top by a generally horizontal length of the rebar. The bottom of each leg is secured in place with rebar spacing hoops that are wire tied to the leg. The direct embedded section also includes an extension with flanges at the top and bottom thereof. The extension extends above the top of the concrete poured in the annular ring and is used to connect the foundation to the tower to be supported thereon. The direct embedded section takes the place of the tower anchor bolts and embedment ring that are part of the first embodiment.

The remainder of the construction of the second embodiment of the foundation is essentially the same as that already described in connection with the first embodiment, including the pouring of a concrete floor or plug and partial backfilling inside the inner CMP, installation of electrical, communication, and grounding conduits, completion of the backfilling of the inner CMP, and pouring of concrete into the annular ring between the inside of the perimeter wall and the CMP.

When constructed according to either the first or the second embodiment, the ring of overlapping odd and even piles forms an arch between adjacent piles. Compression and friction between the adjacent piles resists soil caving and sloughing pressure when soil inside the generally circular perimeter of the piles is excavated.

Accordingly, one object of the present invention is to overcome the difficulties of constructing deep concrete foundations in weak soil and/or cohesionless sand which are subject to sloughing or caving in when excavated vertically by providing a perimeter pile foundation.

Another object of the present invention is to provide a perimeter pile foundation in accordance with the preceding object that is formed by drilling a plurality of individual pile holes in a large generally circular pattern and filling them with concrete to form a perimeter wall, with the individual piles being contiguous and each pile overlapping the adjacent piles on either side so that the overlapping piles form a continuous arch, with compression between the overlapping piles resisting soil caving and sloughing pressure when soil inside the circle of piles is excavated.

Another object of the present invention is to provide a perimeter pile foundation in accordance with the preceding objects in which a vertical bolt is placed into the concrete of each of the perimeter piles before the concrete stiffens, the bolts extending substantially throughout the length of the pile anchor from top to bottom and having centralizers at one or more intervals along the length of the bolts to keep each bolt in the middle of its respective pile.

Yet another object of the present invention is to provide a perimeter pile foundation in accordance with the preceding objects in which a circular steel ring is placed over the top of the piles, the ring having holes therein through which the pile bolts extend and are secured with nuts to retain bolt tension.

A further object of the present invention is to provide a perimeter pile foundation in accordance with the preceding objects in which a central annular ring or foundation ring of concrete is poured inside the circular pile perimeter, the central foundation ring being provided with structure connecting elements placed in the concrete before the concrete stiffens.

A still further object of the present invention is to provide a perimeter pile foundation in accordance with the preceding objects in which the central foundation ring of concrete is bounded on the outside by the perimeter piles and on the inside by a first corrugated metal pipe (CMP).

Yet another object of the present invention is to provide a perimeter pile foundation in accordance with the preceding objects in which the structure connecting elements include an embedment ring and a plurality of post-tensioned tower anchor bolts.

A further object of the present invention is to provide a perimeter pile foundation in accordance with the preceding two objects in which the foundation further includes a second CMP placed inside the first CMP creating an inner annular ring between the first inner CMP and the second outer CMP, with the tower anchor bolts extending through the inner annular ring which is filled with concrete to complete the tower anchor bolt installation, both the inner and outer CMPs being inside the perimeter piles.

Yet another object of the present invention is to provide a perimeter pile foundation in which the structure connecting elements include a direct embedded section including a reinforcing steel cage secured to a generally cylindrical embedded structure extension having a side wall with a flange at each of its upper and lower ends.

Yet still another object of the present invention is to provide a perimeter pile foundation in accordance with the preceding objects in which concrete is poured to fill the entire volume within the circular pile perimeter.

It is yet another object of the invention to provide a perimeter pile foundation that is not complex in structure and which can be constructed at low cost and is effective in weak saturated soils and/or cohesionless sand that will not allow conventional concrete foundation excavations due to sloughing and caving in of such soils.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE PREFERRED EMBODIMENTS

Figure 1:
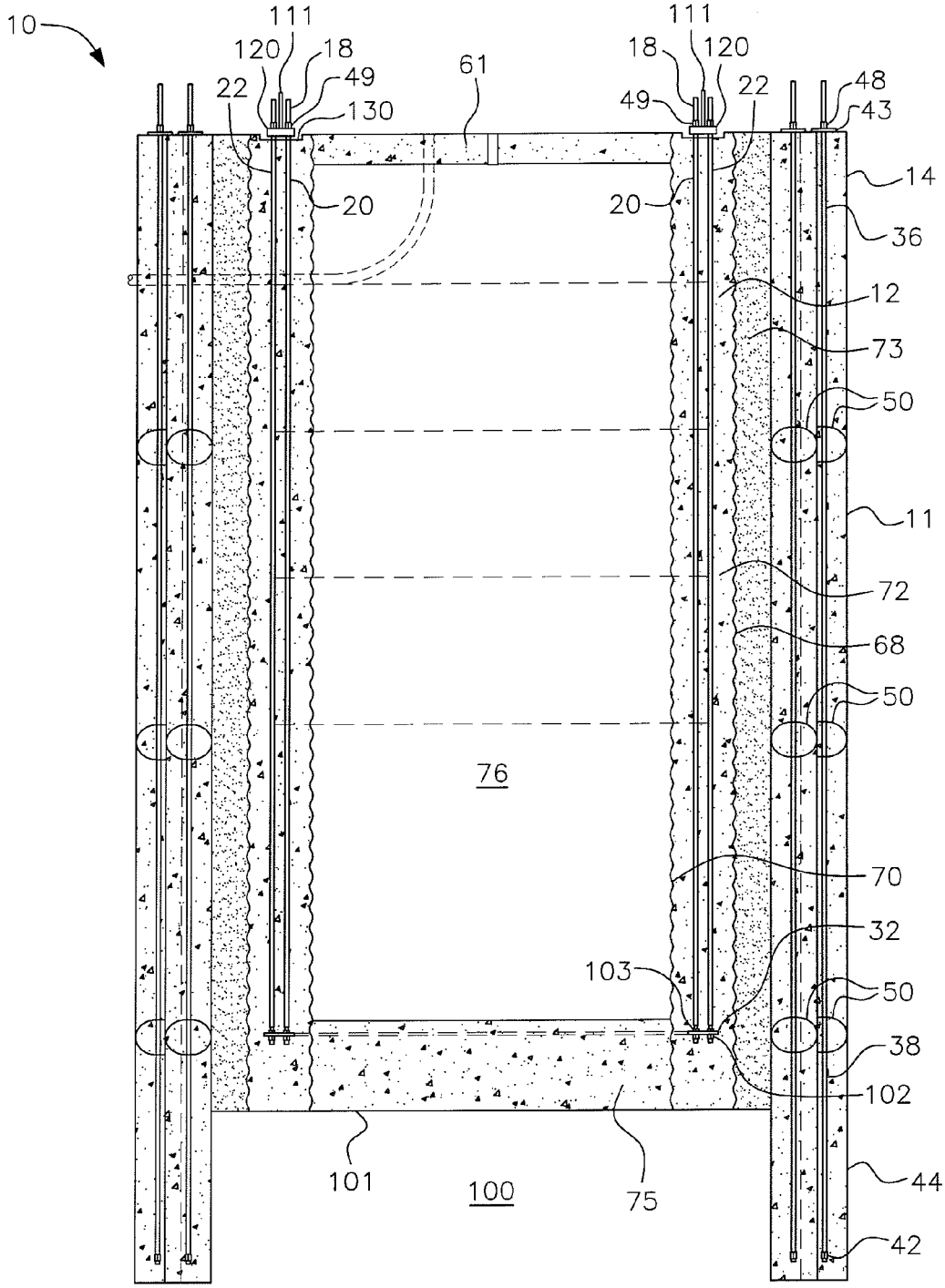
FIG. 1 is a sectional view of a perimeter pile foundation having two tower bolt rings in accordance with a first embodiment of the present invention.

In describing preferred embodiments of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

Figure 1A:
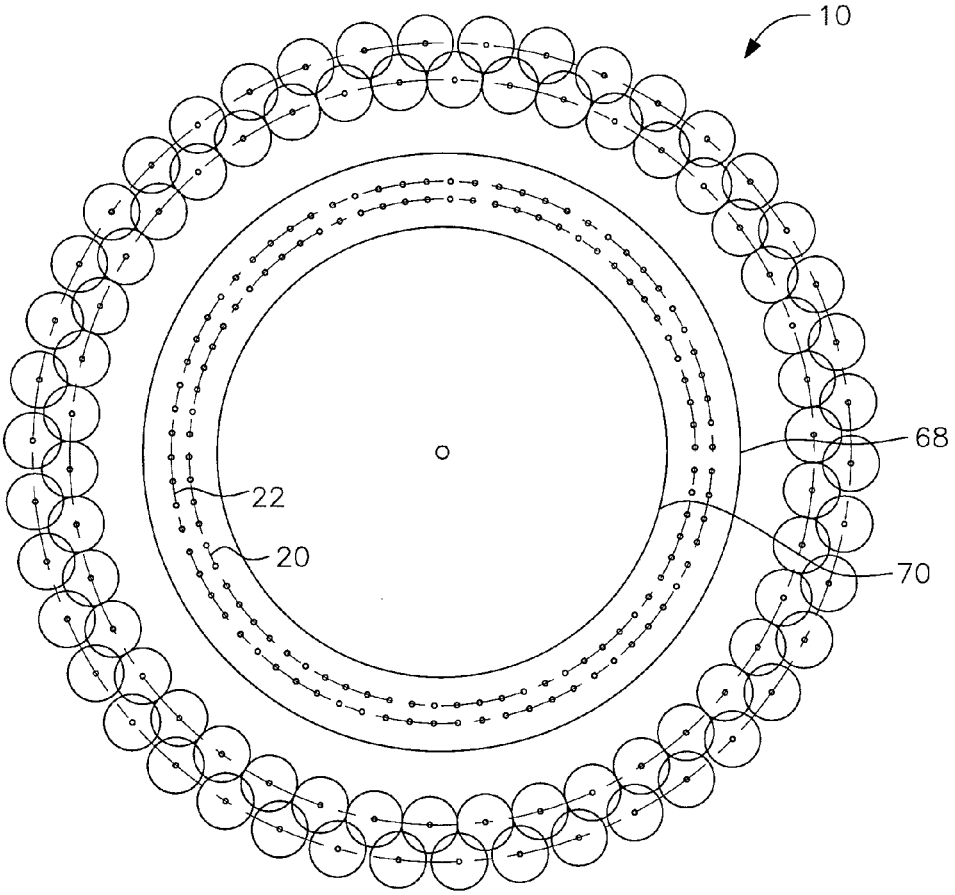
FIG. 1*a* is a top view of a circular arrangement of overlapping pile anchors in accordance with the perimeter pile foundation shown in FIG. 1 with the odd and even piles offset from one another.
Figure 2:
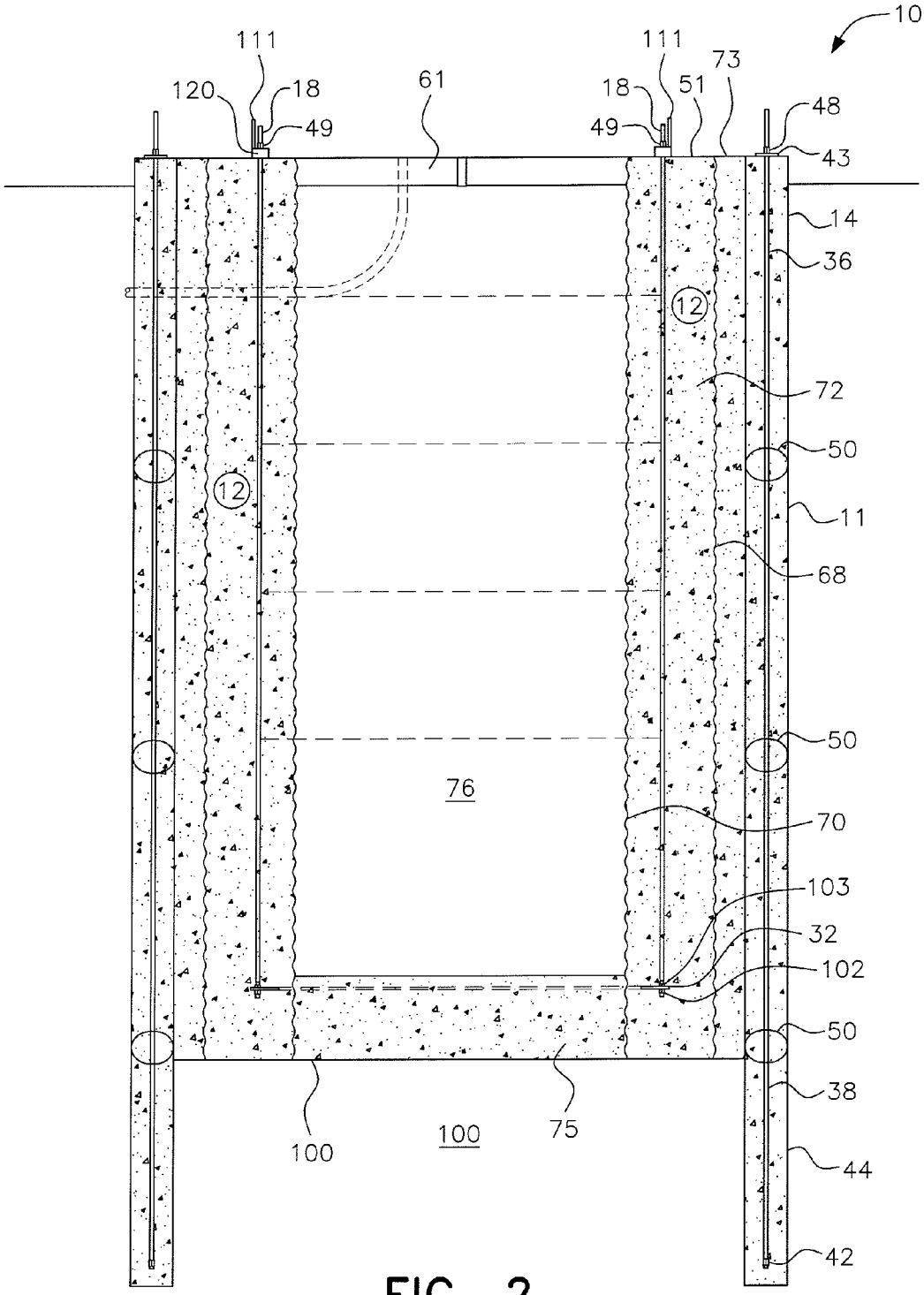
FIG. 2 is a sectional view of a second configuration of the first embodiment of the perimeter pile foundation having a single tower bolt ring in accordance with the present invention.
Figure 3:
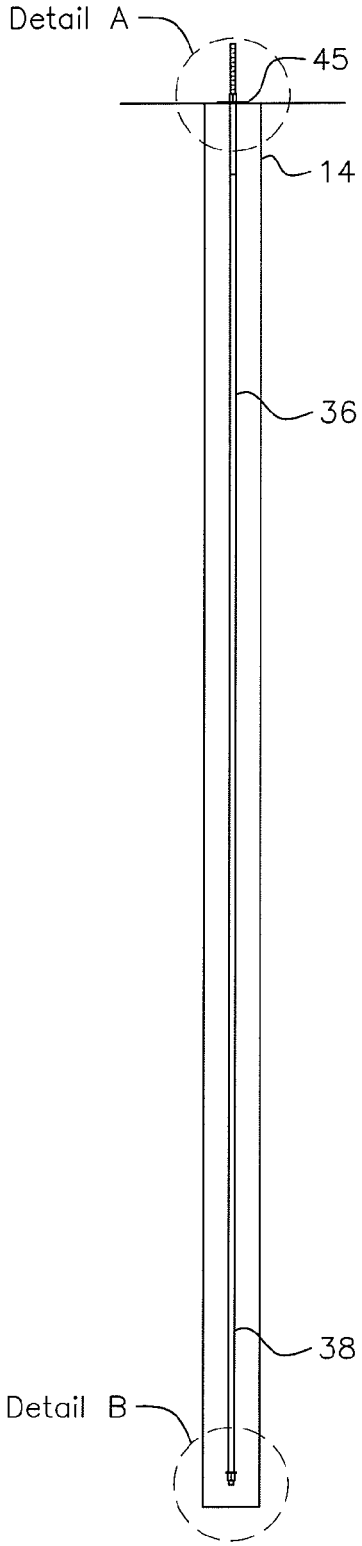
FIG. 3 is a side view of single pile anchor and bolt, like that shown in FIG. 2, in isolation and without centralizers.
Figure 4:
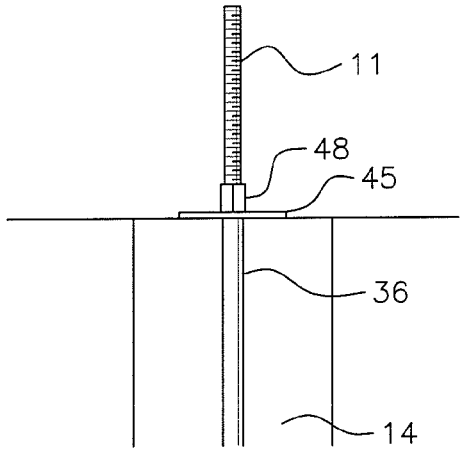
FIG. 4 is an enlarged view of "Detail A" shown in FIG. 3.

A first embodiment of a perimeter pile anchor foundation in accordance with the present invention is shown in FIGS. 1, 1*a* and 2. The perimeter pile anchor foundation, generally designated by reference numeral 10, has a plurality of pile anchors or "piles", each generally designated by the reference numeral 14 extending vertically downward into the soil 100 and forming a perimeter wall, generally designated by reference numeral 11, for the foundation 10. The pile anchors 14 thus serve to secure the concrete foundation 10 into the ground. A first or outer CMP 68 is placed vertically in the excavation inside the perimeter wall 11 to form an outer annular ring, generally designated by reference numeral 73, between the inside of the perimeter wall 11 and the outer CMP 68.

According to the first embodiment, a second or inner CMP 70 is placed inside the outer CMP 68, forming an inner annular ring, also referred to herein as the foundation ring 72. Extending through the concrete foundation ring 72 is a series of tower anchor bolts 18 spaced circumferentially in a circle about the central vertical axis of the foundation. The inner annular ring 72 is filled with concrete 12 either before or after placement of the tower anchor bolts.

The tower anchor bolts 18 can include two bolt circles as in the configuration shown in FIGS. 1 and 1*a*, or one bolt circle as in the configuration shown in FIG. 2. When using a one bolt circle, the bolts and the tower base flange 120 are inside the tower shell, a configuration known in the art as an L flange. With two bolt circles, generally designated by the reference numerals 20 and 22, the bolt circles are positioned in radial pairs and can be used if the tower base flange 120 of the supported tower has a dual bolt circle, with one set of bolts being outside the tower shell 111 and one set of bolts inside the tower shell, resulting in a configuration known in the industry as a T flange.

The inner tower anchor bolt circle 20 has a slightly smaller diameter than the outer tower anchor bolt circle 22. For example, the outer tower anchor bolt circle diameter may be about fourteen feet and the inner tower anchor bolt circle diameter may be about thirteen feet. A tower or other supported structure (not shown) can be attached to the concrete foundation by the tower anchor bolts 18. Structures which can be supported on the perimeter pile anchor foundation of the present invention include, but are not limited to, transmission towers, electrical towers, communication towers, lighting standards, bridge supports, commercial signs, freeway signs, ski lift supports, solar energy towers, wind turbine towers, large stacks or chimneys, silos, tank structures, airport towers, guard towers, etc.

The tower anchor bolts 18 extend through and are nutted atop the circular tower base flange 120 at the bottom of the tower or other supported structure. The bottom ends of the bolts 18 extend to an embedment ring 32 near the bottom of the foundation. The embedment ring 32 contains bolt holes for receiving the bottom ends of each of the tower anchor bolts. The bolt ends are anchored to the ring with suitable nuts 102 and 103 or the like. The embedment ring 32 is preferably constructed of several circumferential segments lap jointed together. The embedment ring 32 is approximately the same size as and is complementary to the tower base flange 120.

The tower anchor bolts 18 are sleeved in elongated hollow tubes, preferably PVC tubes, which cover the anchor bolts except for threaded portions at the top and bottom of the bolts. The anchor bolt sleeves prevent bonding of the bolts to the concrete 12 that is poured into the inner annular ring 72. This sleeved structure allows the tower anchor bolts, with nuts 49, to be elongated when post-stressed between the tower base flange 120 and the embedment ring 32 to alleviate bolt cycling and fatigue. A full description of the tower anchor bolts 18 is set forth in the '217 patent, previously incorporated herein by reference.

As shown in FIGS. 1 and 2, the pile anchors 14 extend below the inner annular or concrete foundation ring 72. Each pile anchor 14 includes an elongated bolt or tendon 36, that extends through a pile anchor base plate 43 on the top surface of the foundation 10, or preferably grouted into the top surface of the foundation, and then into a drilled pile hole 44 that is filled with pile anchor cementitious material to secure the pile anchors 14 in the ground or soil 100. According to one embodiment, the concrete is a sand cement slurry, made with about 5 sacks of cement per cubic yard. The pile bolts 36 are on the order of 1.5 inches in diameter. Centralizers 50 are positioned at various intervals along the length of the bolts 36 to keep each bolt in the middle of its respective pile.

Figure 5:
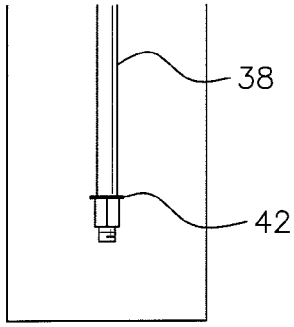
FIG. 5 is an enlarged view of "Detail B" shown in FIG. 3.

The embedded portion of each of the bolts 36 includes a lower end 38 that is bare, i.e., is in direct contact with the cementitious material, for bonding thereto when the cementitious material is poured or pumped to fill the interior of the drilled pile holes 44. The cementitious material preferably fills the pile holes to their bottoms in soil 100. An end nut 42 may be provided on the lower end of the bolt 36 to facilitate bonding of the bolt lower portion 38 with the cementitious material (see FIGS. 1, 2 and 5).

If the pile bolts 36 are to be post-tensioned, the upper end of the embedded portion of the pile bolt 36 is encased in an elongated hollow tube (not shown), preferably in a plastic sleeve or the like, and most preferably by PVC tubing, to prevent bonding with the pile anchor cementitious material and to allow for post-tension stretching. This sleeved structure is fully disclosed in the '217 patent, previously incorporated by reference herein. However, according to the present invention, the pile bolts 36 do not have to be post-tensioned, in which case the sleeve is not included, as is the case shown in FIGS. 1, 2, 3 and 4.

Figure 6:
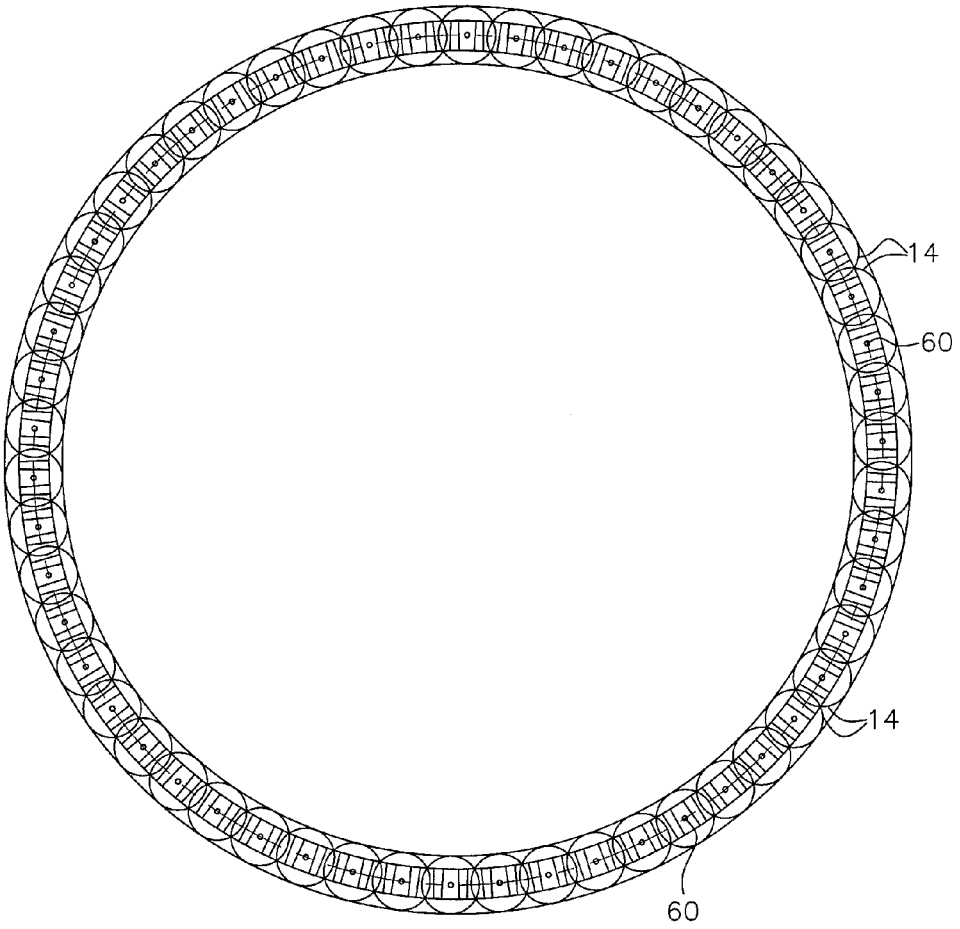
FIG. 6 is a top view of a circular arrangement of overlapping pile anchors in accordance with the perimeter pile foundation shown in FIG. 1, in which the odd and even piles are not offset from one another.
Figure 7:
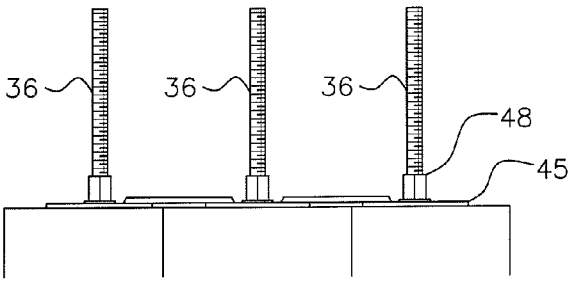
FIG. 7 is a side view of the tops of three adjacent pile anchors with the bolts secured on overlapping individual steel plates.

The perimeter pile foundation of the present invention is built by first drilling and then forming a plurality of individual perimeter pile anchors in a large generally circular pattern as shown in FIGS. 1*a* and 6. The pile anchors 14 are divided into a first group and a second group of piles, referred to herein as the odd and even piles, which alternate with one another around the perimeter of the foundation. The odd piles may be considered the first group or the second group, with the even piles therefore being designated whatever group the odd piles are not.

When forming the perimeter pile "circle", the even and odd piles are preferably offset from one another so that the diameter of the circle formed by the even piles is different from the diameter of the circle formed by the odd piles as shown in FIG. 1*a*. As a result, the overall perimeter formed by the odd and even piles together is not a perfect circle. Other generally circular configurations like that shown in FIG. 6 are also possible. According to the offset embodiment shown in FIG. 1*a*, the difference in the diameter of the odd and even bolt circles is approximately six inches.

Figure 8:
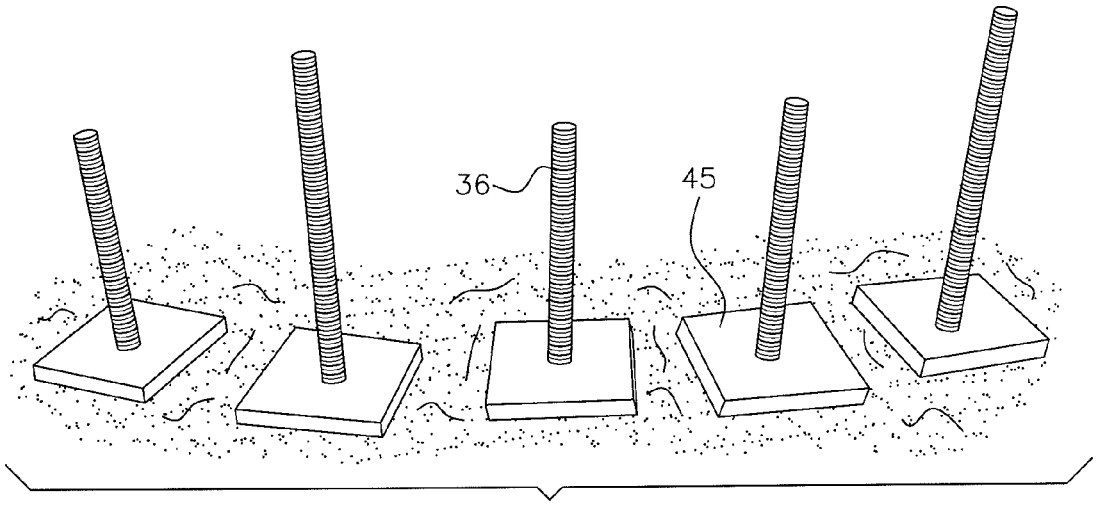
FIG. 8 is a photograph showing a perspective view of five adjacent pile anchor bolts extending upwardly through individual steel plates that are not overlapping.
Figure 9:
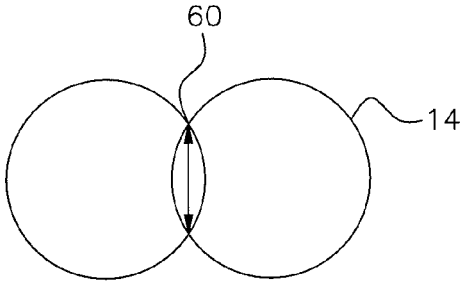
FIG. 9 is an enlarged top view of two overlapping piles as shown in FIG. 6.

The individual circular pile anchors 14 are approximately 18 inches in diameter, and together form a circular pattern that is about 21 feet in diameter. As shown in FIGS. 1*a* and 6, the individual pile anchors 14 are contiguous, each pile anchor having an overlap 60 with the adjacent pile anchors on either side. As shown in FIG. 8, the overlap 60 of the pile anchors 14 is between about one inch and about three inches. With this amount of overlap, the central bolts 36 in the pile anchors 14 that are about 18 inches in diameter are actually about 15 inches apart.

To construct the overlapping pile anchors 14, either the odd piles or the even piles may be constructed first. For purposes of description, the odd pile anchors are formed first by drilling each odd pile hole 44, filling the pile hole with concrete, and inserting a centralized bolt 36 vertically into the concrete to form the pile anchor 14. The last two steps could be reversed.

The even piles are arranged in between the odd piles, with the concrete in the odd piles being allowed to preset to the stage where the concrete is firm but can still be shaved with the auger used to drill the even pile holes. The even pile holes are then drilled, filled with concrete and provided with vertically oriented centralized bolts as with the odd piles to form the even pile anchors 14. The last two steps could be reversed.

The pile holes 44 and pile anchors 14 for the concrete foundation of the present invention can be formed in the soil below the excavation in a variety of ways and using differing equipment, depending upon the condition of the soil, as known to those skilled in the art. For example, the pile hole 44 may be simply formed by a driven mandrel or formed by a screw auger in generally stable soils. However, in unstable soils for which the perimeter pile anchor foundation of the instant application is particularly adaptable, the pile holes are preferably formed by driven pile pipes or pipes drilled, jetted or vibrated in place, such as in U.S. Pat. No. 7,533,505 which is co-owned by the applicant of this application, before positioning the pile anchor bolt, followed by the addition of the cementitious material. Alternately, the pile holes 44 may be drilled and the concrete pressure cast with hollow stemmed augers in wet sands and clays or the hole filled with the cementitious material through a tube which then serves as the anchor bolt. Other methods and equipment to form the pile anchors 14 known to those skilled in the art can be used without departing from the present invention.

Following completion and concrete set of the perimeter pile circle, the soils within the perimeter pile circle are excavated to the foundation depth 101. As shown in FIGS. 1 and 2, the pile anchors may extend a few feet below the intended depth of the foundation to be constructed inside the circular pattern of perimeter pile anchors. This extension of the pile anchors is not necessary, however, as the pile hole depth may be substantially the same as the foundation depth 101.

After the pile anchors have been formed, an annular steel plate 43 formed as a ring having holes therein is placed over the piles. The centralized pile bolts 36 extend through the holes and are secured with nuts 48 to retain bolt tension. Alternatively, the ring may be formed by a plurality of individual steel plates 45, one for each pile, with adjoining steel plates that either overlap, as in FIGS. 4, 6, 7 and 9, or are spaced from one another as in FIG. 8. Having individual steel plates provides for greater flexibility with respect to the adjoining relationship of the piles and the centralized pile bolts.

The pile anchor base plate, whether formed as a ring 43 or as independent plates 45, is preferably grouted into the top surface of the pile anchors 14, forming the perimeter wall 11 of the foundation 10. This can be readily accomplished by blocking out an indentation slightly larger than the dimensions of the base plate, such as by using a Styrofoam or other easily removable form. The use of block-outs is fully discussed in the '217 patent, previously incorporated by reference. The pile anchor base plate(s) should be grouted into the top surface of the pile anchors so that the upper surface of the base plate coincides with the upper surface of the foundation 10.

According to both configurations of the first embodiment, after the soils inside the perimeter wall 11 formed by the piles have been excavated to create area 76 as shown in FIGS. 1 and 2, the first or outer CMP 68 is placed vertically inside the perimeter wall 11 formed by the contiguous piles 14. Placement of the outer CMP creates the outer annular space 73 between the inside of the perimeter piles and the outer CMP. A foundation bolt cage including a plurality of vertically oriented sleeved tower anchor bolts 18 and horizontally oriented embedment ring 32 is installed vertically inside the first CMP 68 with the embedment ring 32 at the bottom. The tower anchor bolts 18 can include two bolt circles in the configuration shown in FIG. 1, or one bolt circle in the configuration shown in FIG. 2.

The tower anchor bolts 18 are nutted at the bottom with the embedment ring 32 with nuts 102 and nutted atop the embedment ring with nuts 103 to secure the embedment ring in place near the bottom of the concrete foundation. The tower anchor bolts are used to secure the tower to the foundation as described in the '217 patent, previously incorporated by reference herein.

The second or inner CMP 70, having a smaller diameter than the first or outer CMP is then installed vertically inside the tower anchor bolts and the first CMP 68. Placement of the second CMP creates the inner annular space defining the inner foundation ring 72 between the outer and inner CMPs through which the tower anchor bolts extend vertically.

A concrete plug 75 is then poured in the bottom of the inner CMP 70, after which the area 76 inside the inner CMP atop the plug is backfilled with soil to approximately five feet below the surrounding ground surface. Alternatively, the entire area inside the inner CMP may be filled with concrete. Electrical, communication, and grounding conduits (not shown) are installed through the first and second CMPs 68, 70 and the perimeter pile anchors 14, and then filling of the inner CMP 70 is completed with soil to within about six inches of the top of the inner CMP 70. Once the backfill is completed, steel welded wire mesh (WWM) atop dobies (not shown) is placed on the backfill and a capped central drain (not shown) is installed and centered into the backfill. Dobies are typically 4" by 4" by 2" concrete blocks with a tie wire cast therein which is used to secure the dobies to rebar.

The inner annular space or foundation ring 72 between the outer and inner CMPs is then filled with concrete to within about three or four inches of the of the top of the CMPs to create a grout trough 130 to complete the concrete foundation ring 72. The six inch floor area and the outer annular space 73 between the outside of the outer CMP 68 and the inside of the perimeter wall is also filled with concrete.

Figure 10:
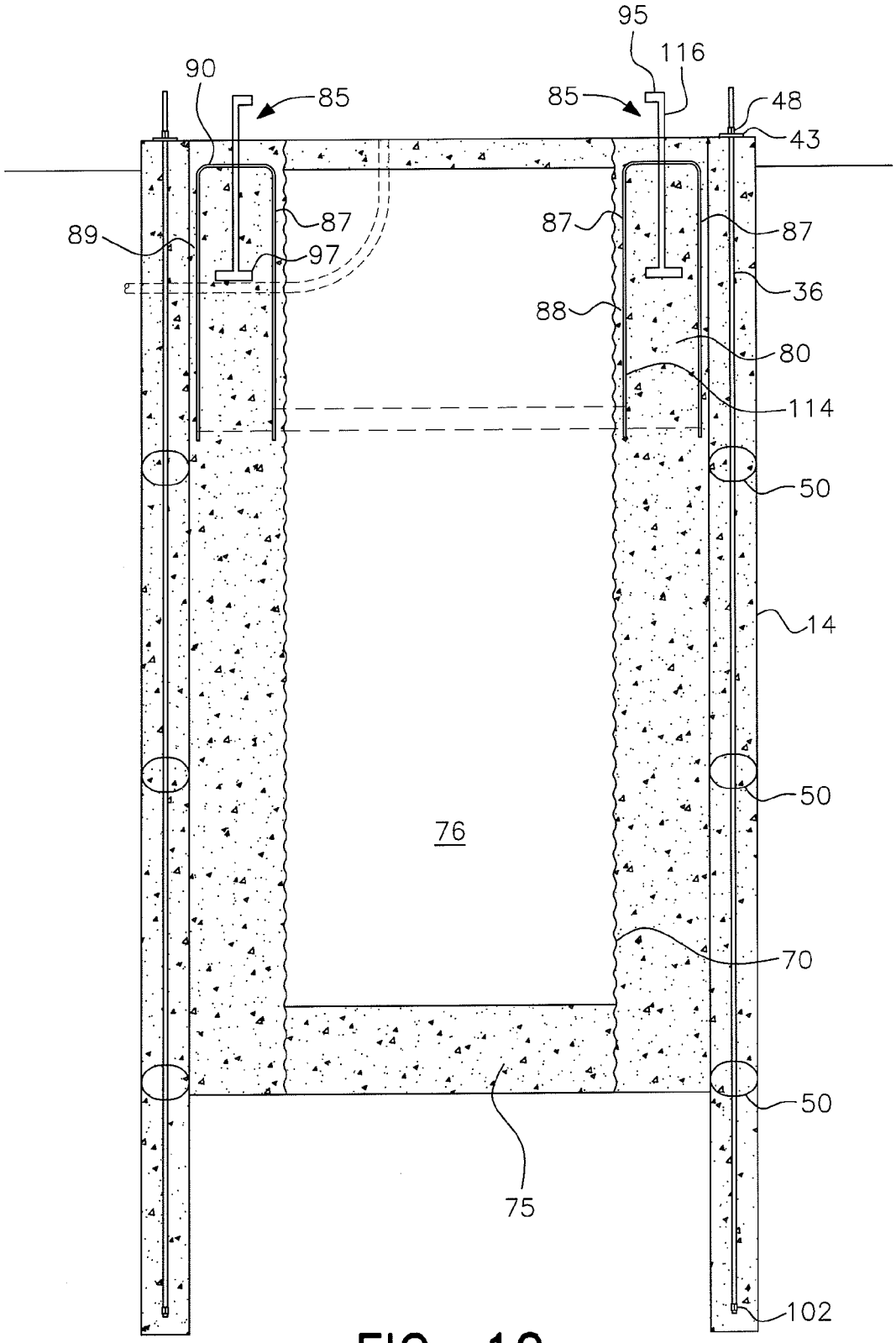
FIG. 10 shows a sectional view of a second embodiment of the perimeter pile foundation in accordance with the present invention.
Figure 11:
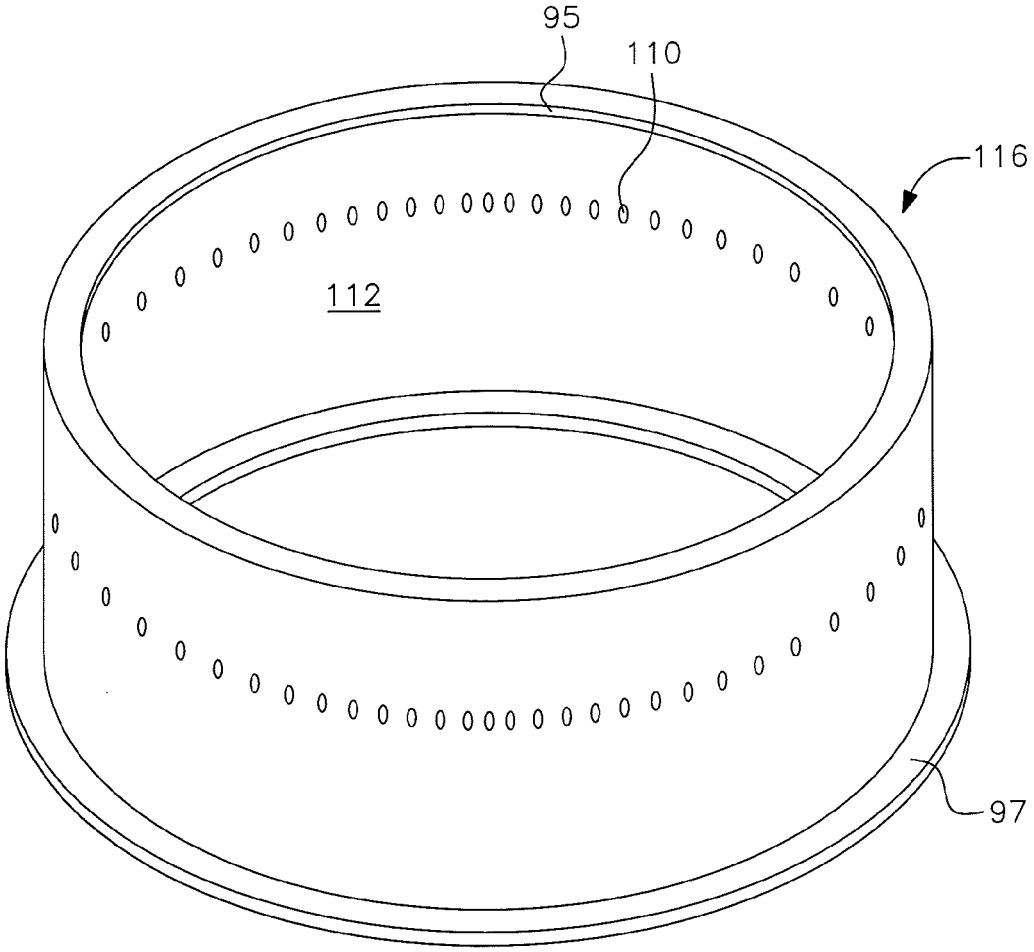
FIG. 11 is a perspective view of the extension of the direct embedded section shown in FIG. 10.

According to a second embodiment shown in FIG. 10, after the pile anchors are formed, only an inner CMP 70 is vertically placed inside the pile perimeter and spaced therefrom to create an annular foundation ring 80 between the CMP 70 and the piles 14. A direct embedded section, generally designated by reference numeral 85, is placed near the top of the foundation ring 80. The direct embedded section 85 includes a generally U-shaped reinforcing steel cage, generally designated by reference numeral 87, formed by a loop of rebar coupled with a structure extension, generally designated by reference numeral 116, which is shown in FIG. 11. The cage 87 is constituted by a piece of rebar bent to have a generally vertical inner leg 88 and a generally vertical outer leg 89 joined at the top by a generally horizontal length 90 of the rebar extending through holes 110 in the generally cylindrical side wall 112 of the extension 116 of the embedded section 85 to form the generally U-shaped configuration for cage 87. Rebar spacing hoops 114 are wire tied near the end of each leg to secure the legs in place in a circular configuration.

The extension 116 of the direct embedded section 85, shown as part of the foundation in FIG. 10 and in isolation in FIG. 11, is separate from the rebar loops which extend through the holes 110 in the extension side wall 112. The extension 116 has a flange 95 at the top and a flange 97 at the bottom. The embedded structure extension 116 is placed between the inner leg 88 and the outer leg 89 of the cage 87, with the extension 116 extending above the top of the concrete poured in the foundation ring 80. The top of the flange 95 is used to connect the foundation to the tower to be supported thereon. Hence, the direct embedded section 85 takes the place of the tower anchor bolts and embedment ring that are used in the first embodiment.

The remainder of the construction of the second embodiment of the foundation is the same as that already described in connection with the first embodiment, including the pouring of a concrete plug and partial backfilling inside the inner CMP, installation of electrical, communication, and grounding conduits, completion of the backfilling of the inner CMP, placement of the steel welded wire mesh (WWM) and the capped central drain, and pouring of concrete into the annular foundation ring 80 and the floor 61.

Figure 12:
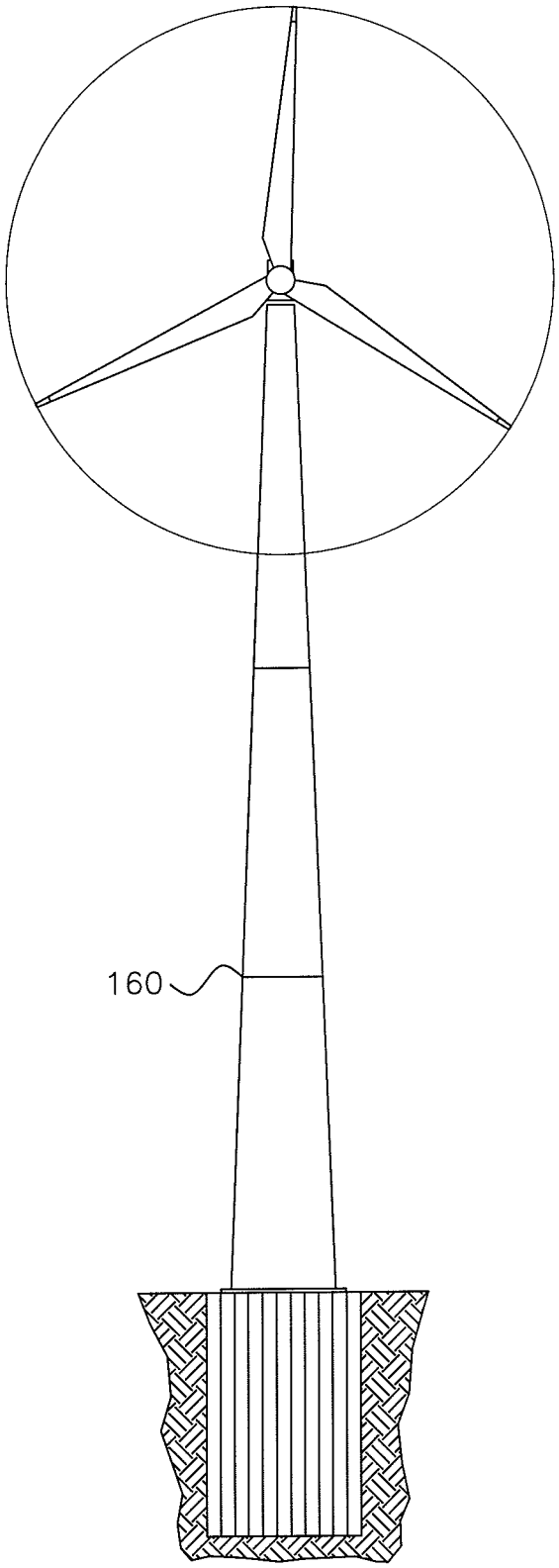
FIG. 12 shows a deep concrete perimeter pile anchor foundation in accordance with the present invention supporting a large tower.

When constructed, both embodiments of the perimeter pile foundation result in a ring of overlapping odd and even pile anchors that form a generally circular peripheral wall, each section of which is formed as an arch. As is known in the art, forces applied to an arch structure are all resolved into compressive stresses. This is useful when building the pile anchor foundation as described herein because building materials such as concrete can strongly resist compression. The horizontal compressive forces acting on the perimeter piles hold the piles against one another in a state of equilibrium. Thus, compression and friction between adjacent piles resist soil caving and sloughing pressure when soil inside the generally circular perimeter of the piles is excavated. The large deep concrete foundation may therefore effectively be used to support a large tower 160 or other structure like that shown in FIG. 12.

It should be understood by those skilled in the art that the foregoing description utilizes the terms "concrete" and "cementitious material" interchangeably. It will be further understood that various cementitious and cementitious-type materials can be utilized in constructing the post-tensioned pile anchor foundation of the present invention as would be utilized by those skilled in the art. These materials include, but are not limited to, sand-cement slurries, grout, and epoxy resins.

Further, while the elongated members in the pile anchors of the present invention have been described as bolts, those skilled in the art will appreciate that other elongated elements, such as strands, cables, rods, pipes, or the like, could be used in accordance with the present invention.

The foregoing descriptions and drawings should be considered as illustrative only of the principles of the invention. The invention may be configured in a variety of shapes and sizes and is not limited by the dimensions of the preferred embodiment. Numerous applications of the present invention will readily occur to those skilled in the art. Therefore, it is not desired to limit the invention to the specific examples disclosed or the exact construction and operation shown and described. Rather, all suitable modifications and equivalents may be resorted to, falling within the scope of the invention.

What is claimed is:

1. A concrete foundation having a pile anchor perimeter wall for supporting a tower or other structure subject to high upset forces which comprises:

a plurality of pile anchors made of cementitious material extending downwardly into surrounding soil, said pile anchors arranged in a generally circular pattern with adjacent pile anchors overlapping one another to form a generally circular pile anchor perimeter wall that defines a continuous pile anchor perimeter, said generally circular perimeter wall surrounding a center area;

a steel plate structure having holes therein placed over said pile anchors;

a plurality of pile anchor bolts each having a lower end adjacent and bonded to cementitious material in a bottom portion of a respective one of said pile anchors, the bolts extending upwardly through the cementitious material of each said pile anchor to an upper end that projects through said holes in said steel plate structure and above an upper surface of said pile anchor cementitious material;

said overlapping pile anchors around said continuous pile anchor perimeter forming a continuous arch, with compression and friction between the overlapping pile anchors resisting soil caving and sloughing pressure when soils in the center area are excavated following formation of the pile anchor perimeter wall;

a first corrugated metal pipe (CMP) placed vertically inside the pile anchor perimeter wall after the center area is excavated, said first CMP being spaced from said pile anchor perimeter wall to create an annular ring between the first CMP and the surrounding pile anchor perimeter wall;

cementitious material filling said annular ring for supporting a tower or other structure from an upper surface of said foundation; and a plurality of structure connecting elements embedded in the foundation and configured to secure a tower or other structure to said upper surface of the foundation.

2. The concrete foundation of claim 1, further comprising a second CMP, smaller in diameter than said first CMP, placed inside the first CMP to define an annular area between the CMPs, said plurality of structure connecting elements being embedded in cementitious material poured in said annular area.

3. The concrete foundation of claim 2, wherein said structure connecting elements include a plurality of tower post-tensioning bolts or tendons each extending between an embedment ring in a lower portion of the foundation, upwardly through said cementitious material in said foundation annular area to an upper end projecting above an upper surface of the foundation for engaging a base plate of a tower or other structure to be supported on said foundation.

4. The concrete foundation of claim 3, wherein each of said tower post-tensioning bolts or tendons is encased in a sleeve from said embedment ring to adjacent said respective upper end to permit free elongation of said tower bolts or tendons through said foundation upon post-tensioning thereof.

5. The concrete foundation of claim 1, wherein the pile anchors are divided into odd and even pile anchors that alternate with one another around the continuous pile anchor perimeter, the odd pile anchors being offset from the even pile anchors so that a diameter of a circle formed by the odd pile anchors is different from a diameter of a circle formed by the even pile anchors.

6. The concrete foundation of claim 1, wherein said pile anchors include centralizers spaced along a length of the pile anchor bolts to keep the bolts centered in the pile anchors.

7. The concrete foundation of claim 1, wherein said steel plate structure is formed as a ring having said holes therein, said ring being placed over the generally circular perimeter wall formed by said pile anchors and said pile anchor bolts extending upwardly through said holes and being nutted against the steel plate ring structure.

8. The concrete foundation of claim 1, wherein said steel plate structure includes a plurality of individual steel plates each having a hole therein, each plate being placed on top of a respective pile anchor so that the pile anchor bolt extends upwardly through the hole and is nutted against the plate.

9. The concrete foundation of claim 1, wherein the overlap of adjacent pile anchors is between from about one inch to about three inches.

10. The concrete foundation of claim 1, wherein said structure connecting elements include a direct embedded section having a reinforcing steel cage formed by a loop of rebar secured with spacing hoops that are wire tied to legs of the steel cage, said structure connecting elements being embedded in said cementitious material in said annular ring.

11. The concrete foundation of claim 10, wherein the direct embedded section includes a flange at the bottom embedded in the foundation, said connecting elements further including an extension of the direct embedded section that projects above the foundation, a top of said extension having a flange.

12. A method for forming a concrete foundation with a pile anchor perimeter wall, said foundation for supporting on its upper surface a tower or other structure subject to high upset forces which comprises the steps of:

defining a circular pattern for drilling a plurality of overlapping piles;

dividing the piles into a first group of piles and a second group of piles, piles in said first and second groups alternating with one another;

forming the first group of piles by drilling each pile hole, filling the pile hole with concrete, and inserting a centralized bolt vertically in the concrete;

allowing the concrete in the first group of piles to preset;

forming the second group of piles by drilling each pile hole, filling the pile hole with concrete, and inserting a centralized bolt vertically in the concrete, the second group of piles being adjacent the first group so that concrete in adjacent piles of the first group is shaved when the second group is drilled to create an overlap between adjacent piles in the first and second groups to form a perimeter wall of contiguous piles;

placing a steel plate over each pile, the steel plate having a hole through which the pile bolt extends, and securing the bolt against the plate with a nut to retain bolt tension;

excavating soils in an area within the perimeter wall formed by the contiguous piles to a foundation depth; and placing a first corrugated metal pipe (CMP) vertically in the excavated area inside the perimeter wall formed by the contiguous piles.

13. The method as set forth in claim 12, further comprising the steps of:

placing a structure connecting element inside the perimeter formed by the contiguous piles, said structure connecting element configured to support said tower or other structure supported on the upper surface of the foundation;

pouring a concrete plug in the bottom of the first CMP;

backfilling an the area inside the first CMP atop the plug to approximately five feet below a surrounding ground surface;

installing electrical, communication, and grounding conduits through the first CMP and the perimeter piles, and then completing backfilling of the first CMP; and filling an annular area between the outside of said first CMP and the pile anchors with concrete.

14. The method as set forth in claim 13, wherein the step of placing the structure connecting element includes vertically installing a foundation bolt cage having a plurality of vertically oriented sleeved tower anchor bolts and a horizontally oriented embedment ring inside the first CMP with the embedment ring at the bottom, the tower anchor bolts being nutted at the bottom with the embedment ring to secure the embedment ring in place near the bottom of the concrete foundation.

15. The method as set forth in claim 14, further comprising the step of, after installing the foundation bolt cage, vertically installing a second CMP, smaller in diameter than the first CMP, inside the tower anchor bolts and the first CMP to create an annular ring between the CMPs.

16. The method as set forth in claim 15, further comprising the steps of pouring concrete into said annular ring to secure the tower anchor bolts and forming a grout trough in an upper surface of said annular ring of concrete.

17. The method as set forth in claim 13, wherein the step of placing the structure connecting element includes placing the structure connecting element in the annular area between the first CMP and the pile anchor perimeter, said step of filling the annular area with concrete securing the structure connecting element that is used to support said tower or other structure on the upper surface of the foundation.

18. The method as set forth in claim 12, wherein the first group of piles and the second group of piles are offset from one another so that the diameter of the circle formed by the first group of piles is different from the diameter of the circle formed by the second group of piles.

19. The method as set forth in claim 12, wherein the steel plate is formed as an annular steel ring with holes spaced therealong at distances corresponding with a distance between the pile bolts.

20. The method as set forth in claim 12, wherein the steel plate includes a plurality of individual steel plates for said plurality of piles, respectively, the steel plates being arranged adjacent one another in a circular pattern corresponding with the piles.

21. The method as set forth in claim 12, further comprising the step of vertically installing a second CMP, smaller in diameter than the first CMP, inside the first CMP to create an annular ring between the first and second CMPs, said structure connecting elements including a plurality of vertically oriented tower anchor elements embedded in cementitious material poured in said annular ring between the first and second CMPs.

22. A concrete foundation having a pile anchor perimeter wall for supporting on its upper surface a tower or other structure subject to high upset forces which comprises:

a plurality of cementitious pile anchors extending downwardly into surrounding soil, said pile anchors including odd piles and even piles arranged in a generally circular pattern, the odd piles being offset from the even piles so that a circle formed by the odd piles has a different diameter than a circle formed by the even piles, adjacent odd and even piles overlapping one another to form a continuous pile anchor wall defining a pile anchor perimeter;

a plurality of pile anchor bolts extending vertically through the cementitious material in each pile anchor over substantially an entire length thereof, an upper end of said pile anchor bolts extending above the cementitious material;

a steel plate being placed over an upper surface of the cementitious material of each pile, the steel plate having a hole through which the pile anchor bolt extends, said bolt being secured against the plate with a nut to retain bolt tension;

said overlapping piles around said continuous pile anchor perimeter forming a continuous arch, with compression and friction between the overlapping piles resisting soil caving and sloughing pressure when soils inside the pile anchor perimeter are excavated to form the foundation;

a corrugated metal pipe (CMP) placed vertically inside the pile anchor perimeter in an area excavated after formation of said pile anchor perimeter, said CMP being spaced from said pile anchor perimeter to create an annular area between the CMP and the pile anchor perimeter, said annular area being filled with cementitious material; and a plurality of structure connecting elements embedded in the cementitious material in said annular area, said structure connecting elements being configured to secure a tower to said foundation.

23. The concrete foundation of claim 22, wherein said pile anchors include centralizers spaced along a length of the pile anchor bolts to keep the bolts centered in the pile.

24. The concrete foundation of claim 22, wherein said steel plate is an annular steel plate formed as a ring having holes therein, said ring being placed over said pile anchors and said pile anchor bolts extending upwardly through said holes and being nutted against the plate.

25. The concrete foundation of claim 22, wherein the steel plate placed on top of each pile anchor is an individual plate having a hole therein, said steel plates being adjacent or overlapping one another.

26. The concrete foundation of claim 22, wherein the overlap of adjacent pile anchors is between from about one inch to about three inches.

27. A tower and a concrete foundation having a pile anchor perimeter wall that supports a tower on an upper surface of said foundation, comprising:

a plurality of cementitious pile anchors extending downwardly into surrounding soil, said pile anchors arranged in a generally circular pattern with adjacent pile anchors overlapping one another to form a continuous pile anchor perimeter wall that defines a pile anchor perimeter;

a plurality of pile anchor bolts each having a lower end adjacent and bonded to a bottom portion of a respective one of said pile anchors, the bolts extending upwardly through each said pile anchor;

a corrugated metal pipe (CMP) placed vertically in an excavated area inside the pile anchor perimeter wall and spaced therefrom to create an annular space between the CMP and the perimeter wall;

cementitious material filling said annular space; and a tower supported on said concrete-filled annular space and pile anchor perimeter wall.

* * * * *